US008029084B2

(12) United States Patent
Uchiyama et al.

(10) Patent No.: US 8,029,084 B2
(45) Date of Patent: Oct. 4, 2011

(54) IMAGE FORMING APPARATUS

(75) Inventors: Akihiko Uchiyama, Numazu (JP); Tatsuya Kobayashi, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 11/412,677

(22) Filed: Apr. 26, 2006

(65) Prior Publication Data

US 2006/0262154 A1 Nov. 23, 2006

(30) Foreign Application Priority Data

May 23, 2005 (JP) ..... 2005-149331

(51) Int. Cl.
*B41J 29/393* (2006.01)

(52) U.S. Cl. ..... 347/19; 347/14; 347/5

(58) Field of Classification Search ..... 347/19, 347/5, 9, 11, 12, 14, 15; 358/1.13, 3.28
See application file for complete search history.

(56) References Cited

U.S. PATENT DOCUMENTS

| | | | | |
|---|---|---|---|---|
| 6,416,151 | B1 * | 7/2002 | Otsuka et al. | 347/19 |
| 6,502,756 | B1 | 1/2003 | Fåhraeus | |
| 7,221,464 | B2 * | 5/2007 | Yamano | 358/1.13 |
| 2005/0052707 | A1 * | 3/2005 | Nelson et al. | 358/3.28 |

* cited by examiner

*Primary Examiner* — Lam S Nguyen
(74) *Attorney, Agent, or Firm* — Canon U.S.A. Inc., I.P. Division

(57) ABSTRACT

At least one exemplary embodiment is directed to an image forming apparatus which can form a stable dot pattern to be used with a digital pen. The dot pattern used by a digital pen can be formed by changing an image forming condition, which is read by the digital pen. The image forming condition can be set based on a reading of an experimental test dot pattern.

5 Claims, 12 Drawing Sheets

| | | | | | |
|---|---|---|---|---|---|
| 1 | 3 | 2 | 3 | 2 | 0 |
| 0 | 2 | 3 | 0 | 1 | 1 |
| 0 | 0 | 1 | 1 | 2 | 3 |
| 0 | 3 | 2 | 3 | 1 | 0 |
| 0 | 0 | 2 | 2 | 1 | 1 |
| 3 | 0 | 3 | 0 | 0 | 0 |

IMAGE FORMING APPARATUS

BACKGROUND OF THE INVENTION

1. Field of the Invention

The present invention relates to an image forming apparatus.

2. Description of the Related Art

Conventionally, paper fill-out forms such as an application form, questionnaire, or answer sheet are filled out by a person to express his intentions by selecting an answer to a question among the given alternatives and marking a predetermined place on the form using a writing instrument such as a pencil, ballpoint pen, or a fountain pen. If a wrong place is marked with a pencil, the incorrect mark is erased with an eraser and the correct place is remarked. In the case where a ballpoint or a fountain pen is used, an incorrect mark is crossed out, and another place is marked.

In recent years, such paper forms have come to be digitized and used as electronic forms. An electronic form is represented by electronic data that includes entry spaces as a plurality of fields corresponding to the entry columns of a paper fill-out form. When such an electronic form is used, the user uploads the electronic form on his computer system and displays it on a display device, and the necessary information is inputted by operating an input device such as a keyboard or a mouse pointer. The inputted information is obtained by the system as electronic data and can be sent to the organization to which the form is to be submitted, for example through a network.

However, a user who does not have sufficient knowledge of how to operate a personal computer, or is not very good at keyboard input, often finds it difficult to use such electronic forms skillfully. Rather, it is easiest for such user to fill out a conventional paper form using a conventional writing instrument.

More recently, a pen-style input device referred to as a "digital pen" or an "electronic pen" has been introduced as an effective input device for such a user. (In the present specification, the input device will be referred to as a "digital pen" hereinafter.) A digital pen is used in pairs with a "special paper" on which a prescribed dot pattern is formed. In addition to a conventional ink-type pen nib, the digital pen is equipped with a miniature camera for reading a dot pattern on the special paper, as well as a wireless communication unit. When the user writes a character on the special paper with the digital pen, the miniature camera detects the dot pattern on the special paper with the movement of the pen, and inputted data such as the character written by the user is obtained. This data is sent to a terminal device such as a personal computer or a cellular phone in the vicinity of the digital pen by the wireless communication unit. A system which uses this digital pen can be used as an input device in place of a keyboard or a mouse pointer, and it is easy to use for a user who has difficulties with operating a personal computer or a keyboard. Contemporaneously, it can be used for organizations such as a public office or a financial institution to which the form can be submitted, in that the entry of the user can be acquired as inputted electronic data instead of a conventional paper fill-out form, so that the data can be used directly in electronic processing. (For example, refer to U.S. Pat. No. 6,502,756).

A paper printed by an offset printing machine using a form plate on which a dot pattern is originally set up is generally used as the above-mentioned special paper for the digital pen. The dot pattern can also be printed by an electrophotographic image forming apparatus connected to a computer. An electrophotographic image forming apparatus is very useful in that a number of special papers can be printed as needed.

However, it can be difficult for an electrophotographic image forming apparatus to always stably output a dot pattern, due to the environment in which the apparatus is placed or the wear pattern of the photosensitive drum or the developing device. Therefore, depending on the circumstances, the dot pattern can become too light for the digital pen to read, or the dot pattern can become too dark that it becomes overly conspicuous. In the case where the dot pattern is too dark, it also leads to wasteful toner consumption.

SUMMARY OF THE INVENTION

At least one exemplary embodiment is directed to an image forming apparatus which can always form a stable dot pattern for use in a digital pen.

At least one exemplary embodiment is directed to an image forming apparatus that can form a dot pattern which information can be obtained by a digital pen, on a recording medium, including an ink pen unit, a reading unit for optically reading a dot pattern, and an information transmission device configured to transmit read information to the outside, where the image forming apparatus includes an image forming condition control mode which controls an image forming condition for forming the dot pattern.

At least one exemplary embodiment is directed to an image forming apparatus, where the image forming condition control mode experimentally forms dot patterns for controlling an image forming condition on a recording medium under at least more than two different image forming conditions. The image forming apparatus reads the dot patterns with the digital pen, and obtains the image forming condition to be used for subsequent forming of a dot pattern according to the read result.

At least one exemplary embodiment is directed to an image forming apparatus where the image forming conditions are at least more than one of: developing; transferring; charging; exposing; and dot pattern forming.

At least one exemplary embodiment is directed to an image forming apparatus where an image forming condition for forming a general image is included among more than two different image forming conditions as above described.

At least one exemplary embodiment is directed to an image forming apparatus where the image forming condition for forming a general image is set based on the detection result of the density level after a toner image is formed for detecting a density level.

According to at least one exemplary embodiment, in an image forming apparatus which can form a dot pattern to be used in a digital pen, a dot pattern which can be read appropriately by a digital pen and for which the least toner is consumed can be formed by using a digital pen that controls the image forming condition.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments of the invention and, together with the description, serve to explain the principles of the invention.

DETAILED DESCRIPTION OF THE EXEMPLARY EMBODIMENTS

Figure 1:
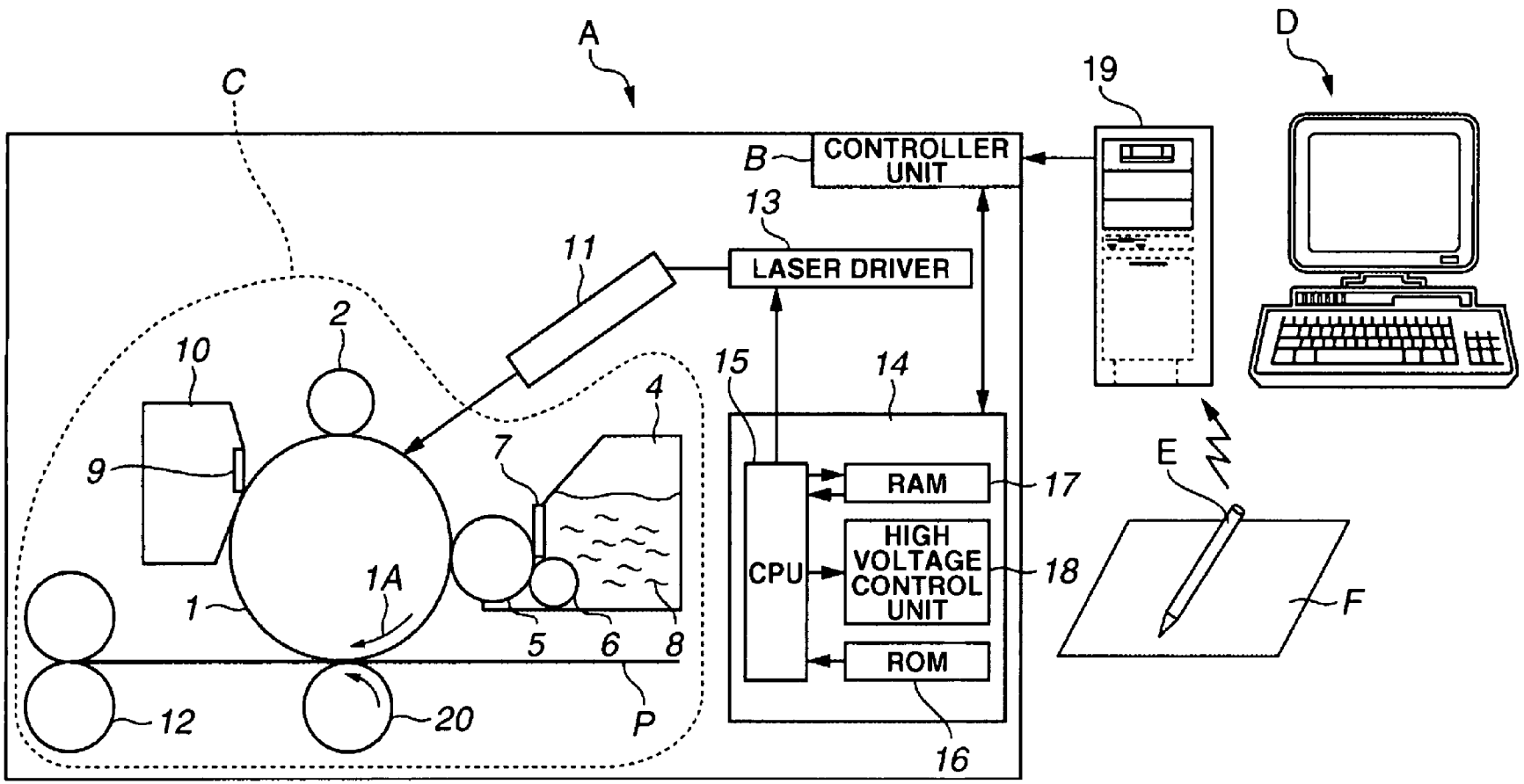
FIG. 1 is a schematic view of an image forming apparatus and a digital pen according to the first exemplary embodiment of the present invention.

The following description of at least one exemplary embodiment is merely illustrative in nature and is in no way intended to limit the invention, its application, or uses.

Processes, techniques, apparatus, and materials as known by one of ordinary skill in the relevant art may not be discussed in detail but are intended to be part of the enabling description where appropriate, for example the fabrication and operation of an electrophotographic image forming apparatus.

In all of the examples illustrated and discussed herein any specific values, for example the values associated with dot placement on the paper, should be interpreted to be illustrative only and non limiting. Thus, other examples of the exemplary embodiments could have different values.

Notice that similar reference numerals and letters refer to similar items in the following figures, and thus once an item is defined in one figure, it may not be discussed for following figures.

Exemplary embodiments of the invention will be described in detail below with reference to the drawings.

First Exemplary Embodiment

FIG. 1 shows an example of an image forming apparatus according to the first exemplary embodiment of the present invention. In FIG. 1, the image forming apparatus A is either a stand-alone apparatus or is connected to the host computer D through a network. The image forming apparatus A can also be connected to the network through a print server (not shown) which can temporarily store the print data. Reference letter E denotes a digital pen and F denotes a special paper for use with the digital pen. The host computer D receives the data sent from the digital pen E to process the data. There can be cases where the host computer D only receives the data from digital pen E, and the data processing is conducted by a different data processing server (not shown) connected to the network. The special paper F for use with the digital pen, the digital pen E, and the configuration of the image forming apparatus A will be described first.

[Special Paper for Use with the Digital Pen]

Figure 2:
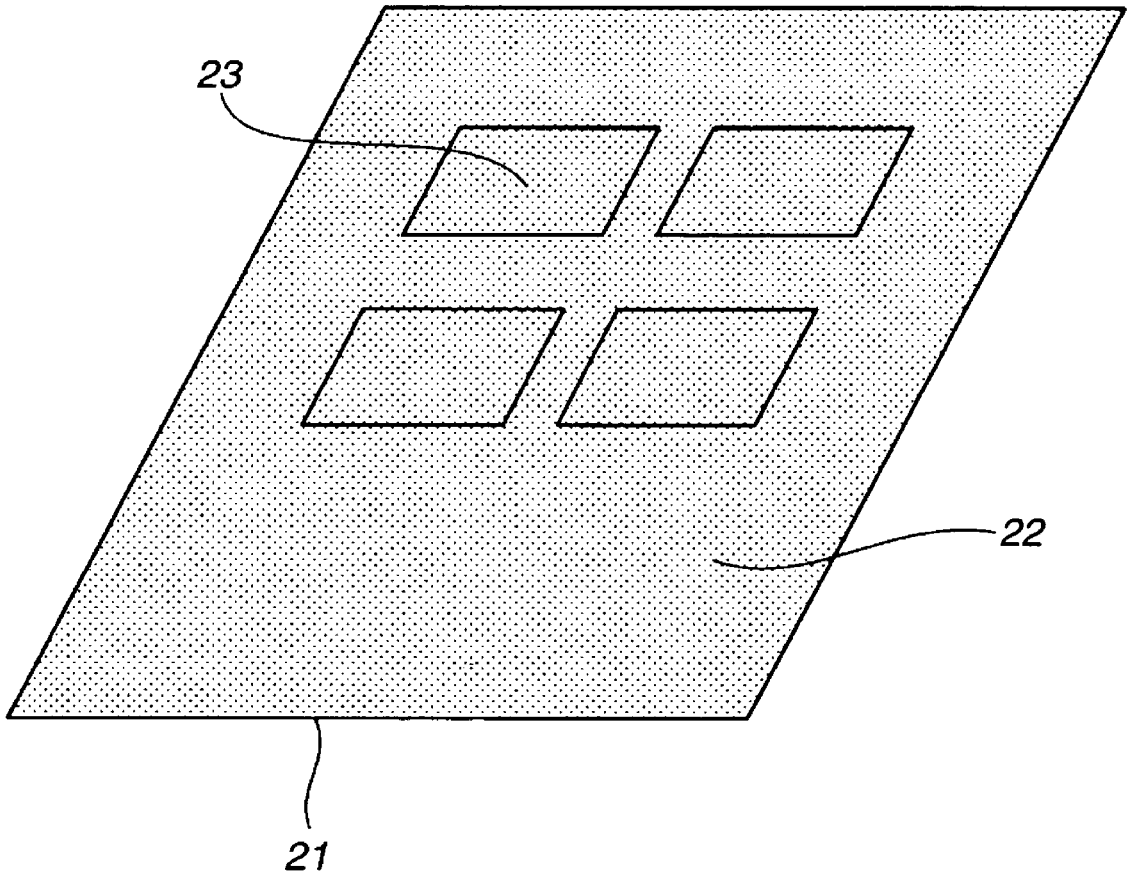
FIG. 2 is a schematic view of the special paper for use with the digital pen.

FIG. 2 illustrates an example of the special paper for use with the digital pen. As shown, in the special paper F (FIG. 1), a dot pattern 22 is formed on a carrier 21, and a pattern 23 such as a ruled line is also formed on the carrier 21. The dot pattern 22 can be formed on all or selected parts of the carrier 21.

The carrier 21 can be a general sheet of paper, and the dot pattern 22 in at least one exemplary embodiment can be formed by a toner which contains carbon.

Figure 3:
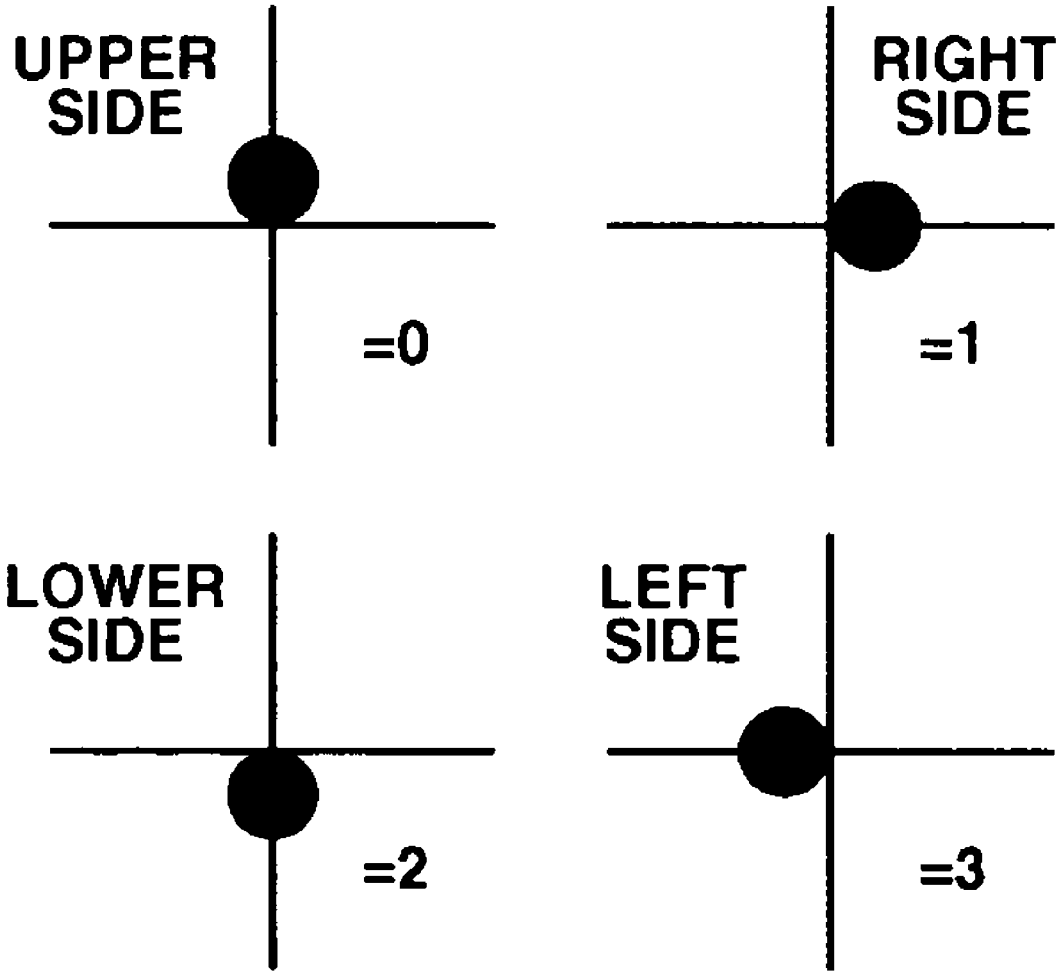
FIG. 3 is a schematic diagram of how a numerical value is allocated to a dot.
Figures 4A, 4B:
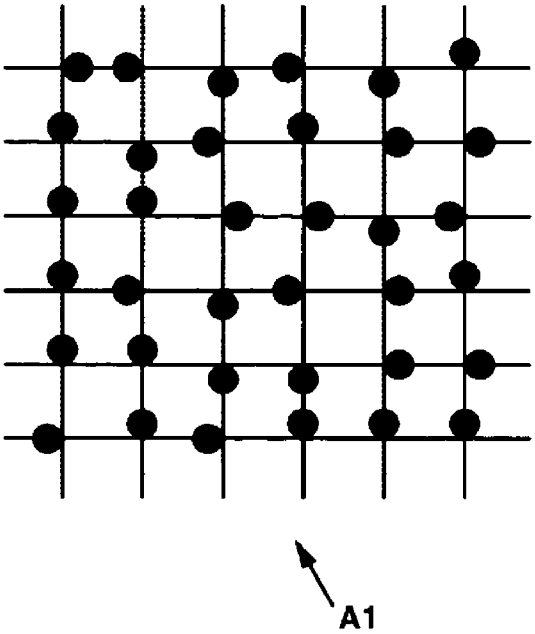
FIGS. 4A-B are schematic diagrams of how numerical information is obtained from the dot pattern.

As illustrated in FIG. 3, the dot pattern 22 can represent 2-bit information from 0 to 3 by displacing the position of the dots vertically and horizontally from the reference position (the intersecting point of the vertical and horizontal line). A combination of these displaced dots can be used to express numerical information. For example, when group A1 of 36 displaced dots is arranged in a reticular pattern as illustrated in FIG. 4A, it expresses numerical information of a data array as illustrated in FIG. 4B. Consequently, the position coordinate (such as the x-y coordinate) on which group A1 of the displaced dots is arranged in the special paper is converted to a numerical information of a data array by encoding it with a prescribed rule. The displaced dots corresponding to the numerical information of the data array configure group A1 of displaced dots. The encoding rule is set to uniquely specify a group of displaced dots against a position coordinate. By applying this procedure to the entire area of the special paper and allocating displaced dots, a given group of displaced dots can be converted to numerical information. By decoding the numerical information, the position coordinate on the special paper on which the displaced dots can be arranged can be obtained.

[Digital Pen]

Figure 5:
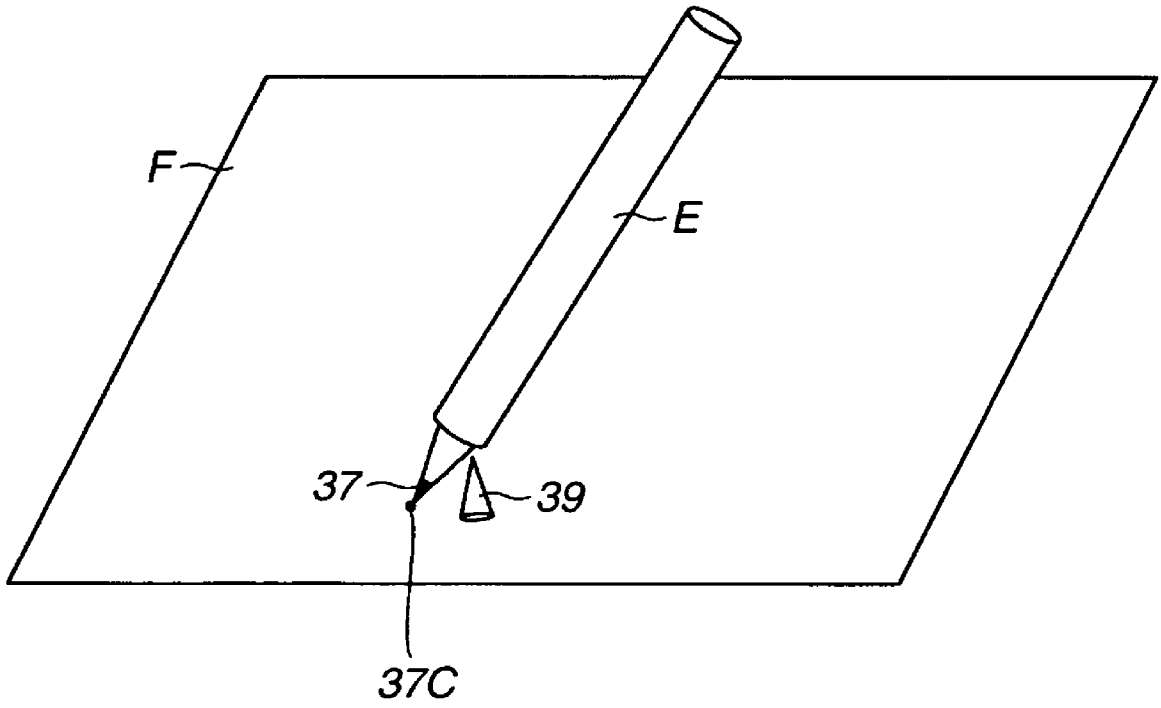
FIG. 5 is a diagram of the digital pen and the special paper for use with the digital pen.
Figure 6:
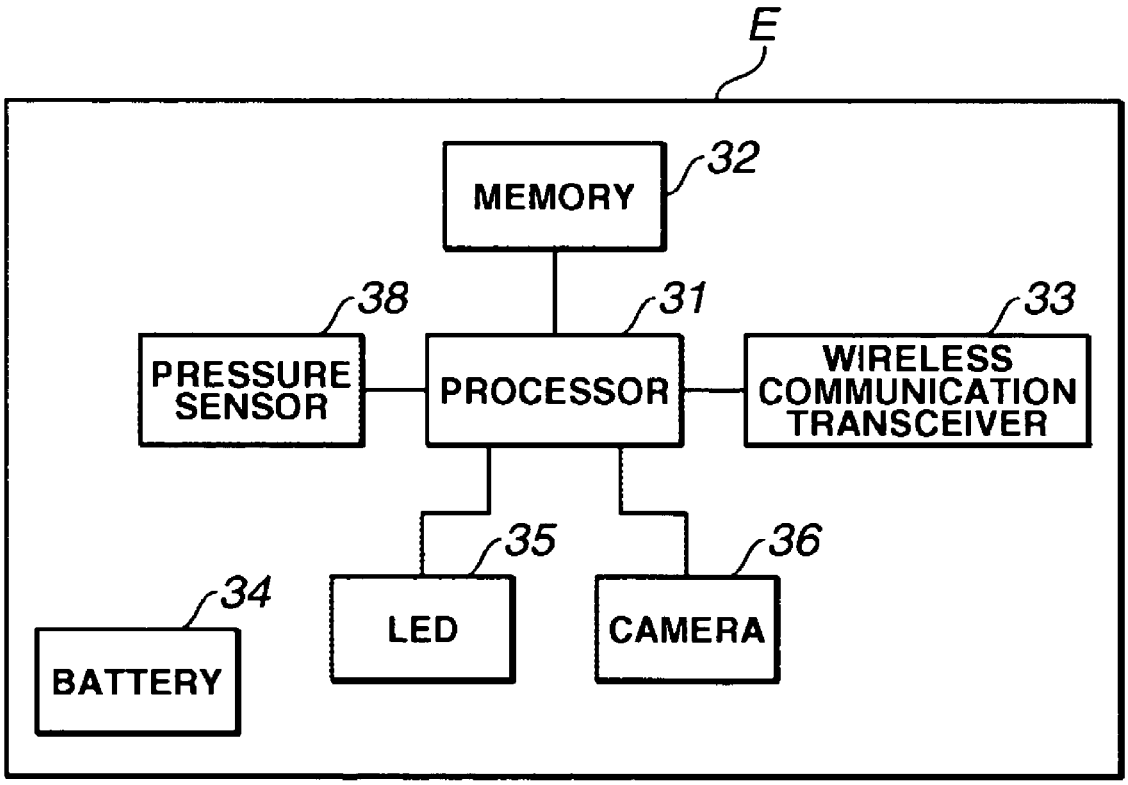
FIG. 6 is a block diagram illustrating the configuration of the digital pen.

FIG. 5 is a schematic diagram showing how a digital pen E is used, and FIG. 6 is a functional block diagram of the structure of the digital pen E.

The digital pen E has a pen nib 37 related to a conventional ink pen, where the user writes characters on the special paper F in the same way as writing with an ink pen.

As illustrated in FIG. 6, the digital pen E includes a processor 31, a memory 32, a wireless communication transceiver 33, a battery 34, an infrared LED 35, a camera 36, and a pressure sensor 38.

In addition, the digital pen E can have an ink cartridge (not shown) and other related or equivalent structure as related to a conventional ink pen. The battery 34 supplies power to each of the components in the digital pen E. For example, the digital pen E can be switched on and off by a digital pen cap (not shown).

The pressure sensor 38 detects the pressure, or the pen pressure, on the pen nib 37 when the user writes on the special paper F with the digital pen E, and provides the detection result to the processor 31. Consequently, when the user writes a character on the special paper F with the digital pen E, the processor 31 detects the pen pressure on the pen nib 37. The processor 31 then determines that the user has started writing and activates the infrared LED and the camera 36.

When the camera is activated, it takes an image of the dot pattern 22 on the special paper as in FIG. 4A. The processor 31 obtains a data array as illustrated in FIG. 4B based on the data of the dot pattern inputted from the camera 36. The processor 31 decodes the data array and calculates the position coordinate on the special paper F corresponding to the position captured by the camera 36 in real time. In the exemplary embodiments, the group of 36 displaced dots can be arranged in variable area size which can have an impact on the camera resolution, for example for an area of 2 mm by 2 mm, the minimum unit of the dot pattern recognition by the camera is also 2 mm by 2 mm.

Furthermore, the processor 31 obtains the array data and the position coordinate data of the pen pressure while the user is writing, and can store the data in the memory 32 with a corresponding time stamp (time data). Since the camer 36 takes 100 images per second, the trace pattern of the digital pen written on the special paper F by the user can be obtained as electronic data.

In other words, the digital pen reads the dot pattern 22 on the special paper F instead of the trace pattern of the ink written on the special paper F by the user. It can be seen in FIG. 5 that the area 39, illuminated by the infrared LED 35 and the camera 36, are actually not coincidental with the position where the pen nib 37 is in contact 37C with the special paper F.

The obtained data can be stored in the memory 32 until the user gives a transmission instruction. When the user issues such an instruction, the data in the memory 32 can be transmitted to a terminal within a predetermined distance from the digital pen E (in this case, the host computer D) by the wireless communication transceiver 33, which is an example of a data transmission device.

In at least one exemplary embodiment, the digital pen E itself does not have any function button (although other exemplary embodiments can have such a button) such as a transmission button, and the transmission instruction, and other instructions, can be issued by the user, by marking, for example, the transmission box placed on a prescribed position on the special paper Fusing the digital pen E. The transmission instruction can be preassigned to the position coordinate of the transmission box. When the processor 31 receives the position coordinate of the transmission box, the data inside the memory 32 is provided to the wireless communication transceiver 33 to transmit the data to the host computer D. The completion of the data transmission can be indicated by a vibration of the digital pen E or by sound or light or any other method of transmission signaling as known by one of ordinary skill in the relevant arts.

In yet other exemplary embodiments, the digital pen E itself can have a transmission button or can have a function to transmit data in real time. In addition, the transmission device is not limited to the wireless communication transceiver as illustrated in the above example, but it can be carried out by an infrared transmission, by a cable connection, or by transmission through a recording medium.

As described, the digital pen E obtains the coordinate data and the pen pressure data corresponding to a character that the user has written on the special paper F, and transmits them to the host computer D in its vicinity. On the other hand, since the pen nib 37 of the digital pen E can be the same as a conventional ink pen, the contents written on the special paper F remain as an original copy. That is, the contents being written on the original copy can be digitized in real time in the form of coordinate data.

[Image Forming Apparatus]

In FIG. 1, the image forming apparatus A includes a controller unit B (pattern formation device controller) and an engine unit C (pattern formation device). The image data created by an application software within the host computer D is outputted as a print data through a printer driver 19 and sent to the controller unit B. In the controller unit B, processes such as rasterizing are conducted on the received image data, and the processed data is sent to the engine unit C.

The engine unit C includes a photosensitive drum 1 (e.g., an aluminum cylinder whose outer surface is coated with an organic photoreceptor (OPC)). The photosensitive drum 1 is driven in the direction of the arrow 1A as illustrated in the figure by a driving apparatus (not shown), and is uniformly charged to a predetermined potential by the charging roller 2.

In the upper part of the main body of the apparatus is a scanner unit (not shown) which scans with laser generated by the laser driver 13 using a polygon mirror, or an exposure device 11 (e.g., constituted of an LED array).

After undergoing processes such as rasterizing in the controller unit B, the image data is inputted to the laser driver 13. The laser driver 13 causes the exposure device 11 to emit light, and a latent image is formed on the photosensitive drum 1. As the photosensitive drum 1 rotates further in the direction of the arrow 1A as indicated, the latent image is developed by the developing device 4.

The developing device 4 includes a developing sleeve 5, a developer coating roller 6, a developer coating blade 7, and contains a non-magnetic single-component developer (non-magnetic toner) 8. The developing device 4 applies the non-magnetic toner on the surface of the developing sleeve 5 with a developer coating roller 6, and regulates the thickness of the toner layer using the blade 7. The developing sleeve 5 is rotated to convey the thickness-regulated toner to the developing position facing the photosensitive drum 1. A developing bias is applied on the developing sleeve 5 by a developing bias application power source (not shown) so that the toner on the developing sleeve 5 adheres to the electrostatic latent image on the surface of the photosensitive drum 1 to be developed, and the electrostatic latent image is visualized as a toner image.

The visualized toner image which is developed is transferred onto the transfer paper P by the transfer roller 20 on which a predetermined bias is applied. The transfer paper P is conveyed to the fixing device 12, and the visualized toner image is fixed by fusing to become a permanent image.

The residual toner remaining on the photosensitive drum 1 is cleaned by a cleaning device 10, which can have a cleaning blade 9.

The reference numeral 14 denotes the control unit of the image forming apparatus A which includes a CPU 15, to which a laser driver 13, a ROM 16, a RAM 17, and a high voltage control unit 18 are connected. The ROM 16 can be a read-only memory, storing programs and various data with which the CPU 15 controls the image forming apparatus. The RAM 17 can be a readable and writable memory used as a work area for data expansion. The high voltage control unit 18 generates various high voltages of a predetermined value by instruction from the CPU 15.

[The Method for Controlling Image Forming Condition]

Figure 7:
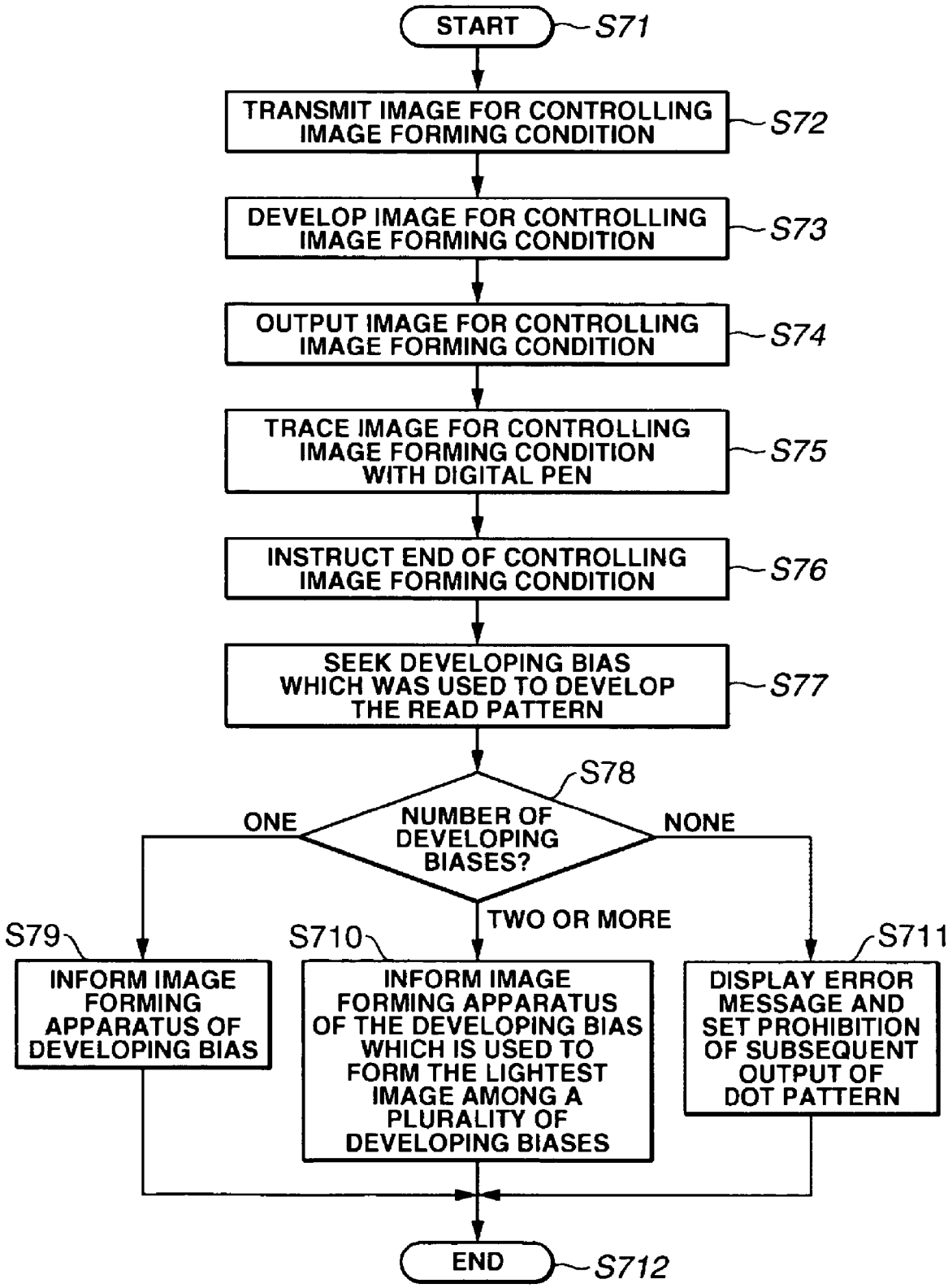
FIG. 7 is a flowchart of the procedure for determining the image forming condition.

The method for controlling image forming condition in the above configuration according to at least one exemplary embodiment is explained using the flowchart in FIG. 7.

Figure 8:
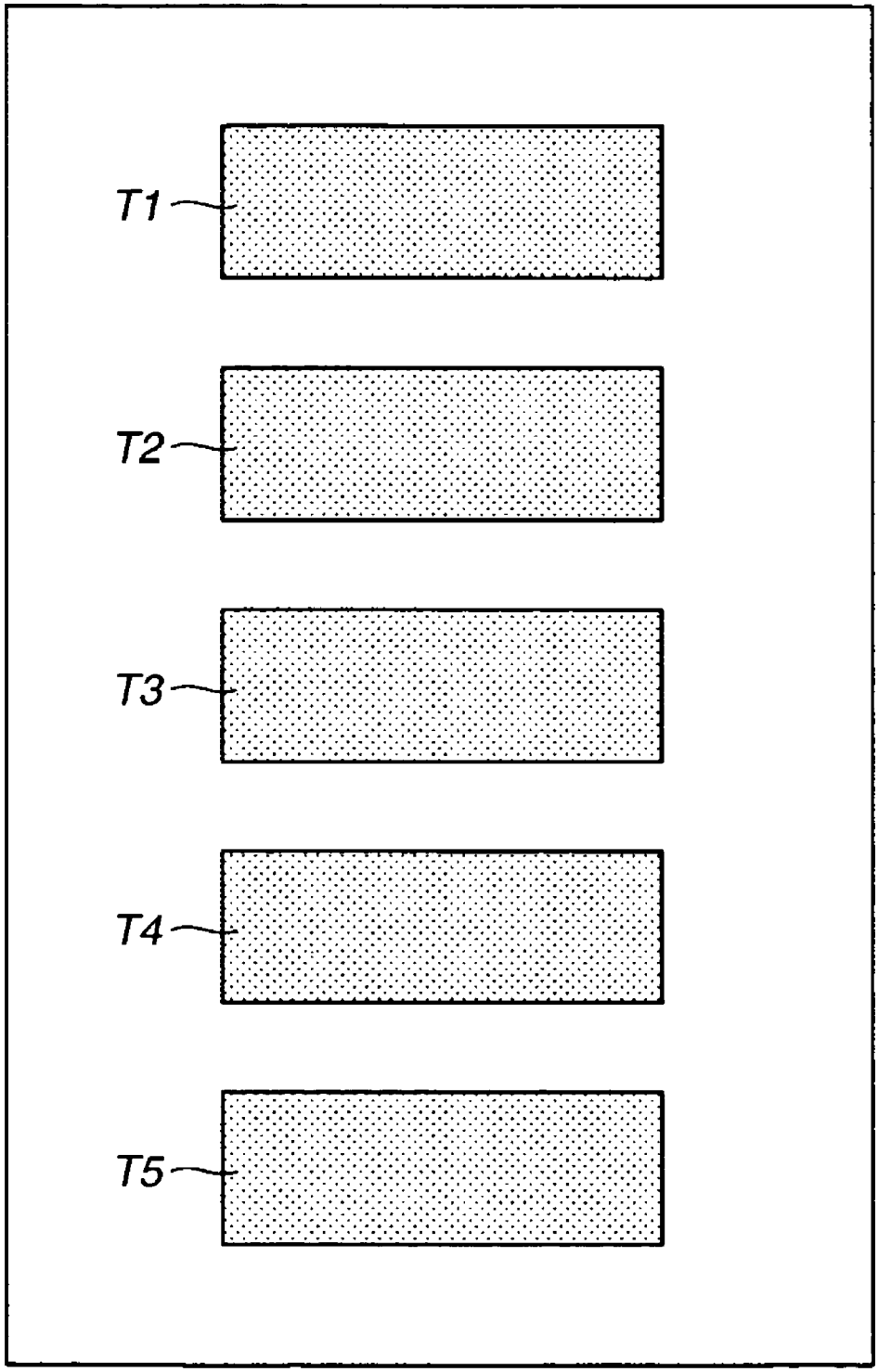
FIG. 8 is a diagram of the image outputted when the image forming condition is controlled.

First, when the application software of the host computer D or the printer driver instructs to control the image forming condition (S71), an image data for controlling the image forming condition is sent from the host computer D to the image forming apparatus A (S72). The image data includes dot patterns (test patterns) T1 to T5 surrounded by square frames placed at predetermined intervals as in FIG. 8.

After forming the latent images of the dot patterns T1 to T5 on the photosensitive drum 1, the image forming apparatus A develops the dot patterns by changing the developing bias from V1 to V5 in synchronization with the dot patterns T1 to T5 (S73) and outputs the transfer medium on which the dot patterns T1 to T5 are formed (S74). A developing bias setting for controlling the image forming condition preliminarily stored in the ROM 16 can be used as the developing bias V1 to V5. A development bias value with a developing bias (Vref) at the center, can also be used which is generally employed in image formation. In this case, the development bias can be increased or decreased, for example, by 20V as illustrated in Table 1.

TABLE 1

| V1 | V2 | V3 | V4 | V5 |
|---|---|---|---|---|
| Vref − 40 | Vref − 20 | Vref | Vref + 20 | Vref + 40 |

After the images for controlling the image forming condition are outputted, the area inside the square frames of the dot patterns T1 to T5 of the outputted images are traced with a digital pen (S75). If the digital pen can recognize the dot pattern which is a pattern exclusively for controlling the image forming condition, the position information read by the digital pen is sent to the host computer D. From the position information, it is determined which one of the patterns T1 to T5 was read, which can be recorded. That is, the pattern information that was read by the digital pen can be recorded onto the host computer D. In other words, the developing bias which formed the pattern whose position information can not be read by the digital pen is not appropriate for forming a dot pattern.

When the digital pen finishes tracing the patterns T1 to T5, the application software or the printer driver of the host computer D gives instructions to end the control of the image forming condition (S76).

Next, the application software or the printer driver seeks the developing bias used in forming the pattern recorded in the host computer D from the pattern (S77), and the subsequent control is changed according to the number of the developing bias (S78). If one pattern can be recorded, the image forming apparatus A is notified that the developing bias used in forming that pattern will be the developing bias for the subsequent forming of the dot pattern (S79). On the other hand, in the case where a plurality of patterns are recorded, the image forming apparatus A is notified that the developing bias which forms the lightest image among the developing bias for forming these dot patterns can be the developing bias for the subsequent forming of the dot pattern (S710). In the case where no pattern can be recorded, a control error message is displayed on the screen, and the outputting of the dot pattern is prohibited until the developing bias is set in the next control of the image forming condition (S711). The control of image forming condition then ends (S712).

The above developing bias can be used in forming the dot pattern on a special paper for use with the digital pen, and in a general image formation, the Vref can be used, or the developing bias can be used in common with a general image output.

By the above exemplary embodiment, an image forming condition can be set that can consistently form a dot pattern readable by a digital pen and can keep the toner consumption to the least amount.

Second Exemplary Embodiment

The second exemplary embodiment of the present will be next described. The components, which can have the same constructions and can function as the first exemplary embodiment are denoted by the same reference numerals, and the explanation for these will be omitted.

Figure 9:
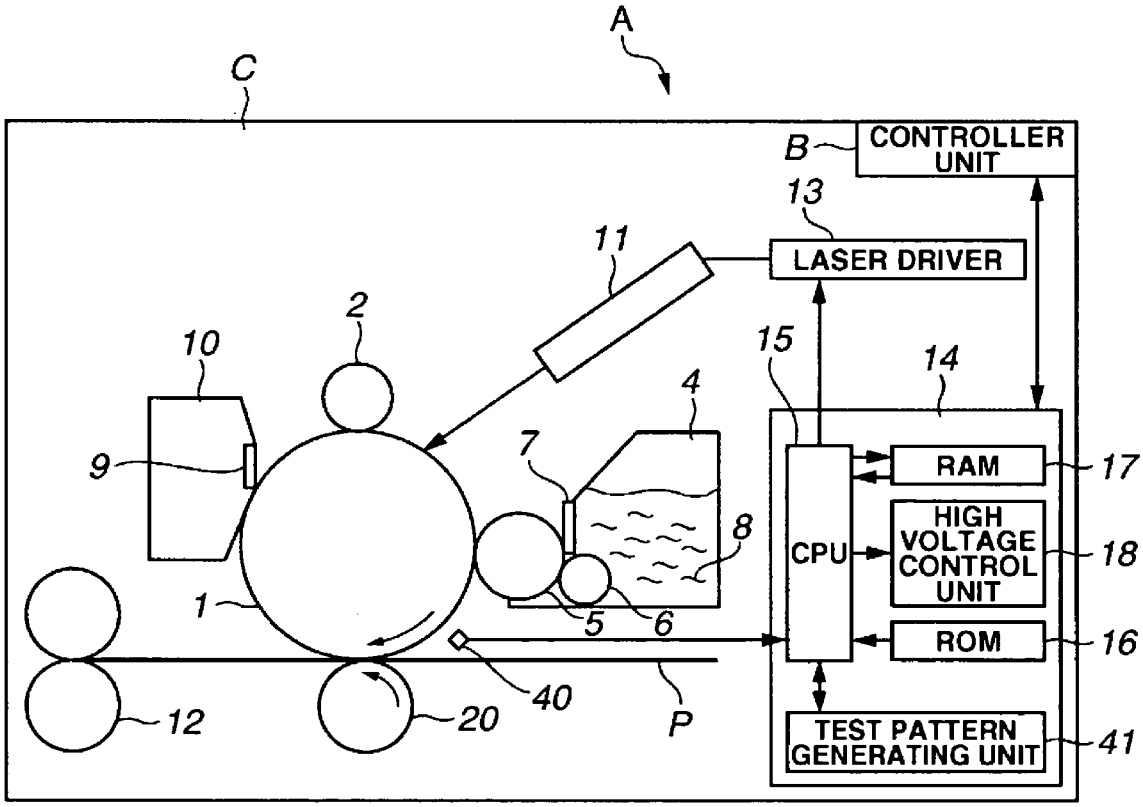
FIG. 9 is a vertical cross-sectional view illustrating the schematic configuration of the image forming apparatus according to the second exemplary embodiment.
Figure 10:
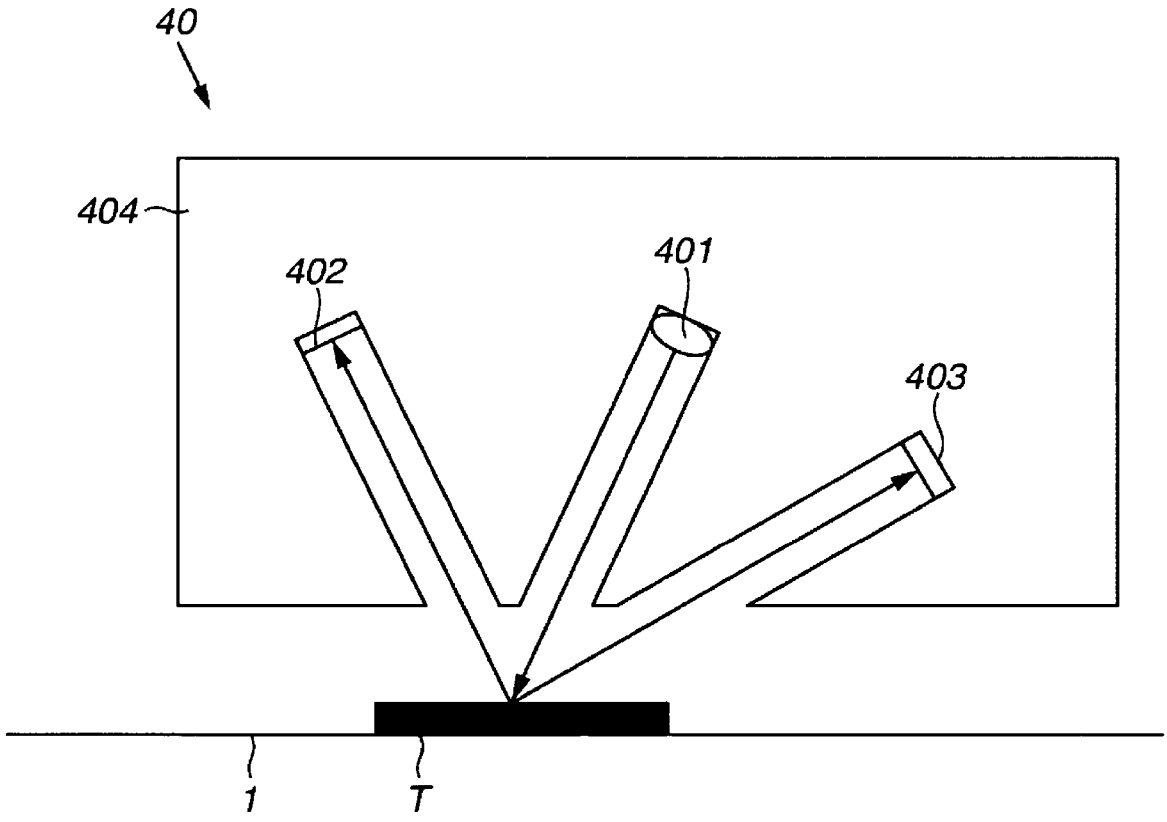
FIG. 10 is a vertical cross-sectional view illustrating the optical density detection sensor.

In an electrophotographic image forming apparatus, an image forming condition control referred to as the toner (recording material) density level control (or control of the amount of the mounted toner) is performed within the apparatus in order to consistently output a stable image. The reference numeral 40 in FIG. 9 denotes an optical density detecting sensor for detecting the density level (the amount of mounted toner) of a toner image (referred to as a patch) T formed on the photosensitive drum 1. As illustrated in FIG. 10, the optical density detecting sensor 40 includes a light emitting element 401 (e.g., an LED), light receiving elements 402, 403 (e.g., a photodiode or CdS), and a holder 404. The light emitted from the light emitting element 401 irradiates the patch T, and the amount of the regularly reflected light is measured by the light receiving element 402 and the amount of diffused light by the light receiving element 403 in order to calculate the density level (the amount of mounted toner) of the patch T.

Using the optical density detection sensor 40, the developing bias required for achieving a predetermined density level (amount of toner mounted) can be obtained. This process is performed by forming a plurality of patches on the photosensitive drum 1 while changing the image forming condition (e.g., the developing bias), and by measuring the density level of the patches with the optical density detection sensor 40.

Figure 11:
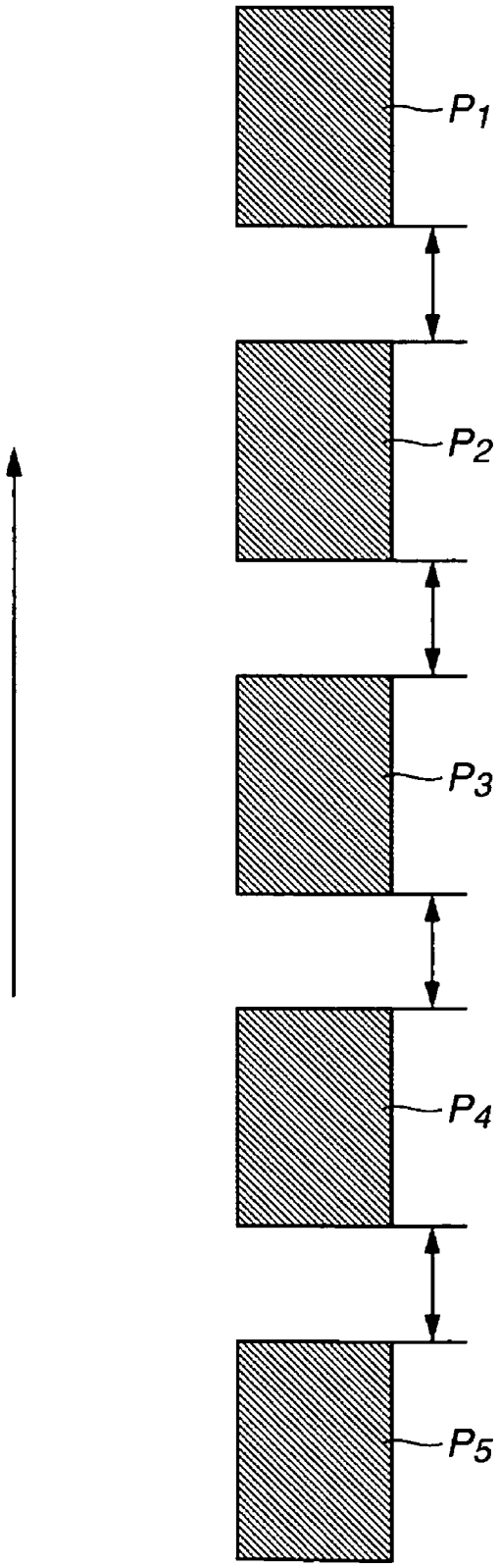
FIG. 11 is a diagram of patches formed on the photosensitive drum.

To be more precise, after the CPU 15 detects an appropriate timing such as the switching on of the image forming apparatus, the time elapsed from switching on the apparatus, the number of pages printed (the number pages of formed images), or an issuing of a command from a host computer or a user, the CPU 15 starts the control of the image density level. First, the CPU 15 reads the various bias settings and the target density level for the developing bias control from the ROM 16 and writes them onto the RAM 17. When the image of the patch is formed, an appropriate bias setting value is read out from the RAM 17 to be sent to the high voltage control unit 18. The CPU 15 then starts the initial operation of the image forming apparatus and charges the photosensitive drum 1 by a predetermined charge bias. The CPU 15 next sends the image data of the patch generated by the test pattern generating unit 41 to the laser driver 13, and using the same image data, the latent images of multiple patches (e.g., five patches P1 to P5 as in FIG. 11) are formed on the photosensitive drum 1 at a predetermined interval in a rotation direction of the drum 1. The latent images formed on the photosensitive drum 1 are developed by the developing device 4. Patch P1 is developed by developing bias VP1, P2 by VP2, P3 by VP3, P4 by VP4, and P5 by VP5 respectively. Note that exemplary embodiments are not limited to any specific number of patches and developing bias. The toner images of the patches P1 to P5 formed on the photosensitive drum 1 are detected at an appropriate timing by the optical density detection sensor 40, and the detected density values D1 to D5 are written onto the RAM 17.

Figure 12:
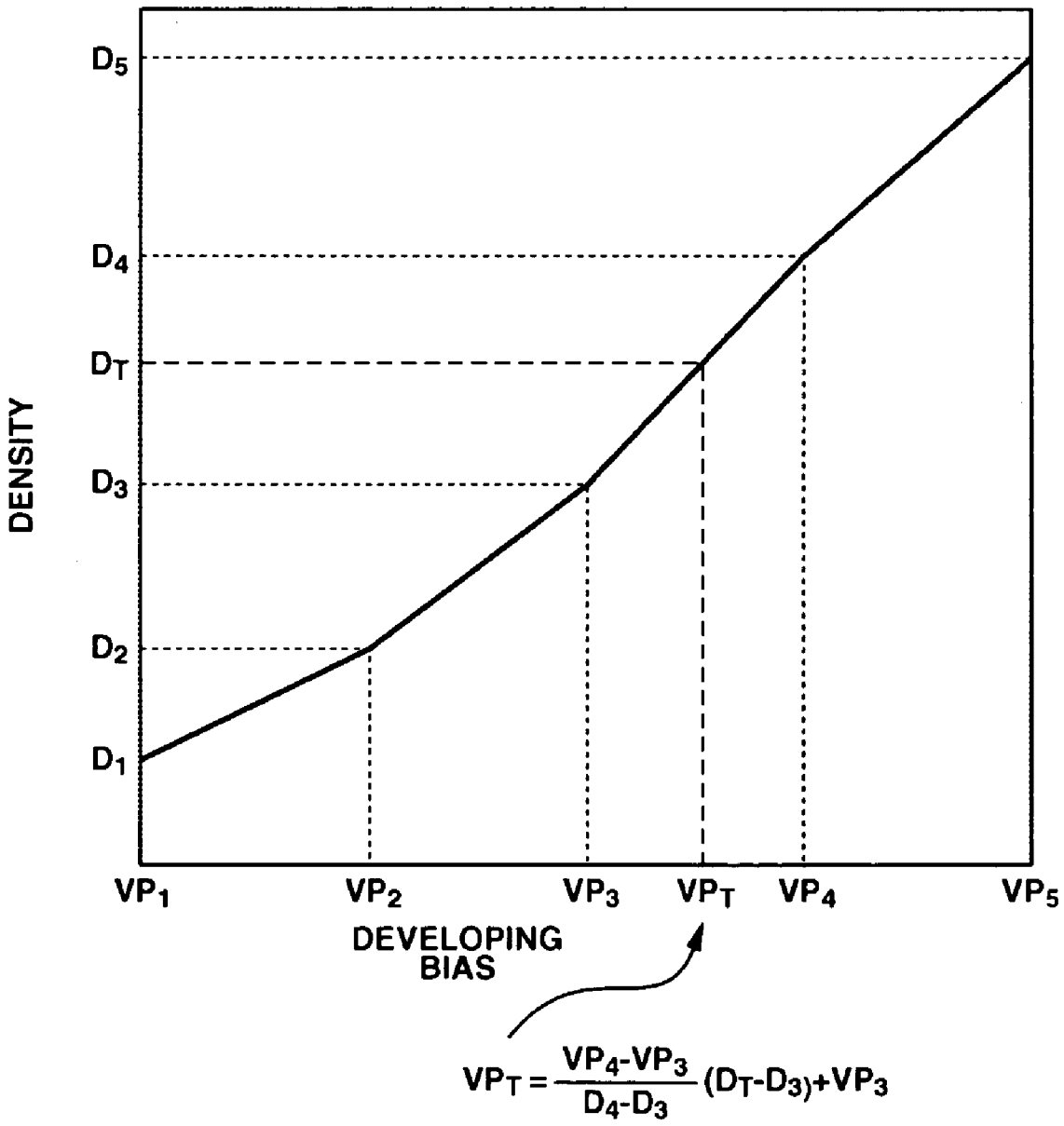
FIG. 12 is a diagram of how the developing bias is determined.

After the patches are detected, the CPU 15 calculates the developing bias required for obtaining the predetermined density level using the density levels of the patches stored in the RAM 17. When the latent images of the patches P1 to P5 for detecting the density level are developed by the developing bias VP1 to VP5 differing from each other, the density levels D1 to D5 detected by the optical density detection sensor 40 become as illustrated in FIG. 12. As illustrated in the FIG. 12, the developing bias VP1 to VP5 can be previously set so that the control target density level DT can be between D1 to D5. In the case where DT is between D3 and D4, the developing bias VPT for obtaining the control target density level DT can be calculated from a linear interpolation as below, using the developing bias VP3 and VP4 and the patch density levels D3 and D4 between which DT is located as expressed in equation 1.

$$VPT=[(VP4-VP3)/(D4-D3)]\times(DT-D3)+VP3 \quad (1)$$

The CPU 15 writes the developing bias VPT thus obtained, onto the RAM 16. This developing bias VPT is used in the gradation control to follow or in a subsequent image formation.

In the present exemplary embodiment, the developing bias VPT obtained above is used as Vref to perform the control of the image forming condition suitable for making a special paper for use with the digital pen.

As illustrated in the present exemplary embodiment, an appropriate developing bias for forming a special paper for use with a digital pen is obtained on the basis of a developing bias suitable for a general image formation which is set by a toner density level control. This reduces the chance that the developing bias, which forms the dot patterns T1 to T5 used for the image forming condition control, will veer far from the optimal value and thus facilitates the setting of an appropriate developing bias.

The image forming apparatus according to at least one exemplary embodiment is not limited to the above exemplary embodiments, and various changes can be made within the scope of the invention. That is, the image forming conditions to be controlled in the image forming condition control can be a charge bias, exposure amount, transferring bias, or dot pattern, all on its own or in a combination. The number of dot patterns formed in the image formation condition control can be other than five.

Furthermore, while the above exemplary embodiments have been described using a monochrome image forming apparatus, the present invention can also be applied to a color image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-149331 filed May 23, 2005, which is hereby incorporated by reference herein in its entirety.

The invention claimed is:

1. An image forming system that forms a dot pattern for a digital pen which has an ink unit, a reading unit which optically reads the dot pattern, and an information transmission unit which transmits information read by the read unit to the outside, wherein the information can be obtained by the reading unit according to trace of user's writing or drawing on paper on which the dot pattern is formed using the digital pen, the image forming system comprising:

an image forming unit which forms an image;

a controller which controls the image forming unit to form a plurality of dot patterns having density different from each other in a plurality of image forming conditions for density different from each other, the density different from each other of the plurality of dot patterns including low density that cannot be read by the reading unit wherein the reading unit of the digital pen reads each of the dot patterns, and the plurality of dot patterns formed by the controls of controller, and wherein the controller controls the image forming condition for density of subsequent formation of the dot pattern by using an image forming condition for density corresponding to a dot pattern with the lowest density among the plurality of dot patterns which can be read by the reading unit, wherein the image forming condition for density includes at least one of charge bias, exposure amount, and transferring bias, and wherein the controller controls said at least one of charge bias, exposure amount, and transferring bias to control the image forming condition.

2. An image forming apparatus that forms a dot pattern from which information can be obtained using a digital pen, where the digital pen comprises an ink unit, a reading unit which optically reads a dot pattern, and an information transmission unit which transmits read information to the outside, wherein the image forming apparatus comprises:

an image forming condition controller which controls an image forming condition for forming the dot pattern, wherein the image forming condition controller experimentally forms test sections having dot patterns, wherein the experimentally formed test sections are read by a digital pen, wherein at least two image forming conditions are used to select one of the test sections, and where the image forming conditions of the selected test section is used as an image forming condition for subsequent formation of a dot patterns, wherein at least one of the image forming conditions is used for forming a general image.

3. The image forming apparatus according to claim 2, wherein the image forming condition for forming a general image is set based on a density level detected after a toner image is formed for measuring a density level and its density level is detected.

4. An image forming method that forms a dot pattern for a digital pen which has an ink unit, a reading unit which optically reads the dot pattern, and an information transmission unit which transmits information read by the read unit to the outside, and wherein the information can be obtained by the reading unit according to trace of user's writing or drawing on the paper formed the dot pattern using the digital pen, the image forming method comprising:

controlling a forming of a plurality of dot patterns having density different from each other in a plurality of image forming conditions for density different from each other, the density different from each other of the plurality of dot patterns including low density that cannot be read by the reading unit, wherein the reading unit of the digital pen reads each of the dot patterns, and the plurality of dot patterns formed by the step of the controlling, and wherein step of the controlling controls the image forming condition for density of subsequent formation of the dot pattern by using an image forming condition for density corresponding to a dot pattern with the lowest density among the plurality of dot patterns which can be read by the reading unit, wherein the image forming condition for density includes at least one of charge bias, exposure amount, and transferring bias, and wherein the controller controls said at least one of charge bias, exposure amount, and transferring bias to control the image forming condition.

5. The image forming system according to claim 1, wherein the image forming condition for density further includes a dot pattern, and wherein the controller controls the dot pattern to control the image forming condition.

* * * * *